US011700897B2

(12) United States Patent
Lazic

(10) Patent No.: US 11,700,897 B2
(45) Date of Patent: Jul. 18, 2023

(54) POCKET FOR A GARMENT

(71) Applicant: LULULEMON ATHLETICA CANADA INC., Vancouver (CA)

(72) Inventor: Natasa Lazic, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 108 days.

(21) Appl. No.: 16/860,847

(22) Filed: Apr. 28, 2020

(65) Prior Publication Data

US 2020/0352267 A1 Nov. 12, 2020

Related U.S. Application Data

(60) Provisional application No. 62/844,052, filed on May 6, 2019.

(51) Int. Cl.
*A41D 27/20* (2006.01)

(52) U.S. Cl.
CPC ..... *A41D 27/207* (2013.01); *A41D 27/201* (2013.01); *A41D 2300/22* (2013.01)

(58) Field of Classification Search
CPC ..... A41D 27/207; A41D 2300/22; A41D 2400/80; A41D 27/205; A41D 27/201; A41B 2400/80
See application file for complete search history.

(56) References Cited

U.S. PATENT DOCUMENTS 1,355,044 A * 10/1920 Hjelm ..... A41D 27/20 2/252
1,821,837 A * 9/1931 Johnson, V ..... A41D 27/20 2/254
2,291,414 A * 7/1942 Slobotkin ..... A41D 27/201 2/254
2,385,163 A * 9/1945 Riedel ..... A41D 27/207 2/254
2,486,584 A * 11/1949 Yagodnik ..... A41D 27/20 2/253
2,746,058 A * 5/1956 Greer ..... A41D 27/207 2/249
2,883,673 A * 4/1959 Solomon ..... A41D 27/207 2/253
2,899,684 A * 8/1959 Riley ..... A41D 27/207 2/254
3,772,708 A * 11/1973 Segelin ..... A41D 27/20 2/253
3,981,028 A * 9/1976 Siegel ..... A41D 27/207 2/254
4,451,935 A * 6/1984 Henschel ..... A42B 1/241 2/181
4,553,269 A * 11/1985 Nowak ..... A41D 27/207 2/254

(Continued)

*Primary Examiner* — Alissa L Hoey
(74) *Attorney, Agent, or Firm* — Conneely PC; Joseph Conneely

(57) ABSTRACT

Examples of a pocket for a garment are described. The pocket for a garment, such as sport apparel, comprises an outer pocket panel and an inner pocket panel attached along respective side edges and bottom edges so that a pocket opening is formed therebetween. An elastic or silicone gripping surface is formed on an inner face of the pocket so that when an item is inserted into the pocket, it removably adheres or sticks to the griping surface preventing or reducing bouncing action of the item within the pocket.

15 Claims, 5 Drawing Sheets

(56) References Cited

U.S. PATENT DOCUMENTS 4,716,600 A * 1/1988 van Beek ..... A41D 27/201 2/250
6,760,926 B1 * 7/2004 Miller ..... A41D 27/201 2/250
8,806,666 B2 * 8/2014 D'Alessandro ..... A41D 27/20 2/250
9,060,555 B1 * 6/2015 Harris ..... A41D 27/207
9,775,392 B2 * 10/2017 Peterson ..... A41D 27/201
10,681,939 B2 * 6/2020 DeSimone ..... A41B 17/00
2004/0133966 A1 * 7/2004 Ebihara ..... A41D 27/207 2/247
2005/0246823 A1 * 11/2005 Groom ..... A41D 27/20 2/247
2009/0172860 A1 * 7/2009 Tomlinson ..... A41D 3/00 2/85
2012/0047631 A1 * 3/2012 Connolly ..... A41D 27/205 2/272
2012/0054939 A1 * 3/2012 Chow ..... A41D 27/205 2/69
2012/0266353 A1 * 10/2012 Ferre ..... A41D 13/0012 2/125
2012/0304357 A1 * 12/2012 Highfield ..... A41D 13/0518 2/69
2014/0259297 A1 * 9/2014 Garabedian ..... A41D 27/207 2/250
2015/0366272 A1 * 12/2015 Wroblewski ..... A41D 27/207 2/69
2016/0183614 A1 * 6/2016 Kuipers ..... A41D 27/204 2/253
2016/0286866 A1 * 10/2016 Carlson ..... A41B 1/08
2016/0331053 A1 * 11/2016 Gordon ..... A41D 7/00
2017/0238634 A1 * 8/2017 Berns ..... A41D 27/207
2018/0084852 A1 * 3/2018 Page ..... A41F 9/00
2018/0199645 A1 * 7/2018 O'Connor ..... A41D 27/205
2018/0206567 A1 * 7/2018 Diakonov ..... A41D 13/0012
2018/0271192 A1 * 9/2018 Parriott ..... A41D 27/207
2019/0159537 A1 * 5/2019 Blythe ..... A41D 27/205
2019/0174839 A1 * 6/2019 McGaughy ..... A41C 3/12
2019/0297972 A1 * 10/2019 Holmes ..... A41F 9/025
2020/0187573 A1 * 6/2020 Junod ..... A41D 1/22
2020/0323286 A1 * 10/2020 Levien ..... A41D 1/06
2020/0337385 A1 * 10/2020 Scott ..... A43B 1/10

* cited by examiner

POCKET FOR A GARMENT

This application claims priority from and the benefit of the filing date of U.S. Provisional Patent Application No. 62/844,052, filed May 6, 2019, and the entire content of such application is incorporated herein by reference.

FIELD

This application relates to the field of sports apparel, and more specifically, to a pocket for a garment such as a skirt or a pair of shorts or pants.

BACKGROUND

Consumers are demanding high performance activewear and sportswear. Typically, sportswear should be snug but needs to provide room for holding personal items such as smart phones, keys, snacks, etc. At the same time, such garments should remain flexible to keep wearers comfortable during stretching, exercising, and other athletic performance.

One problem with existing garments is that they often have pockets that do not adequately secure valuable personal items, such that when the wearer is engaged in stretching, exercising or other athletic activity the items often bounce, shift, or move within the pocket making the wearer uncomfortable.

SUMMARY OF THE APPLICATION

In one aspect, a pocket for a garment is provided. The pocket for the garment comprises a pocket bag with a pocket opening. A gripping surface is formed on an inner face of the pocket, so that when an item is inserted into the internal pocket, it adheres to the griping surface preventing or reducing bouncing action of the item within the pocket.

In another aspect, the pocket comprises a pocket flap attached to either an outer panel or an inner panel along an edge of the pocket opening and at least a portion of the edges on either side of the pocket opening to form an internal pocket. Side edges of the internal pocket are shorter than the side edges of the pocket bag. A bottom edge of the pocket flap is free-hanging forming an entrance opening to the internal pocket. The gripping surface is formed on the inner face of the internal pocket.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

Figure 1:
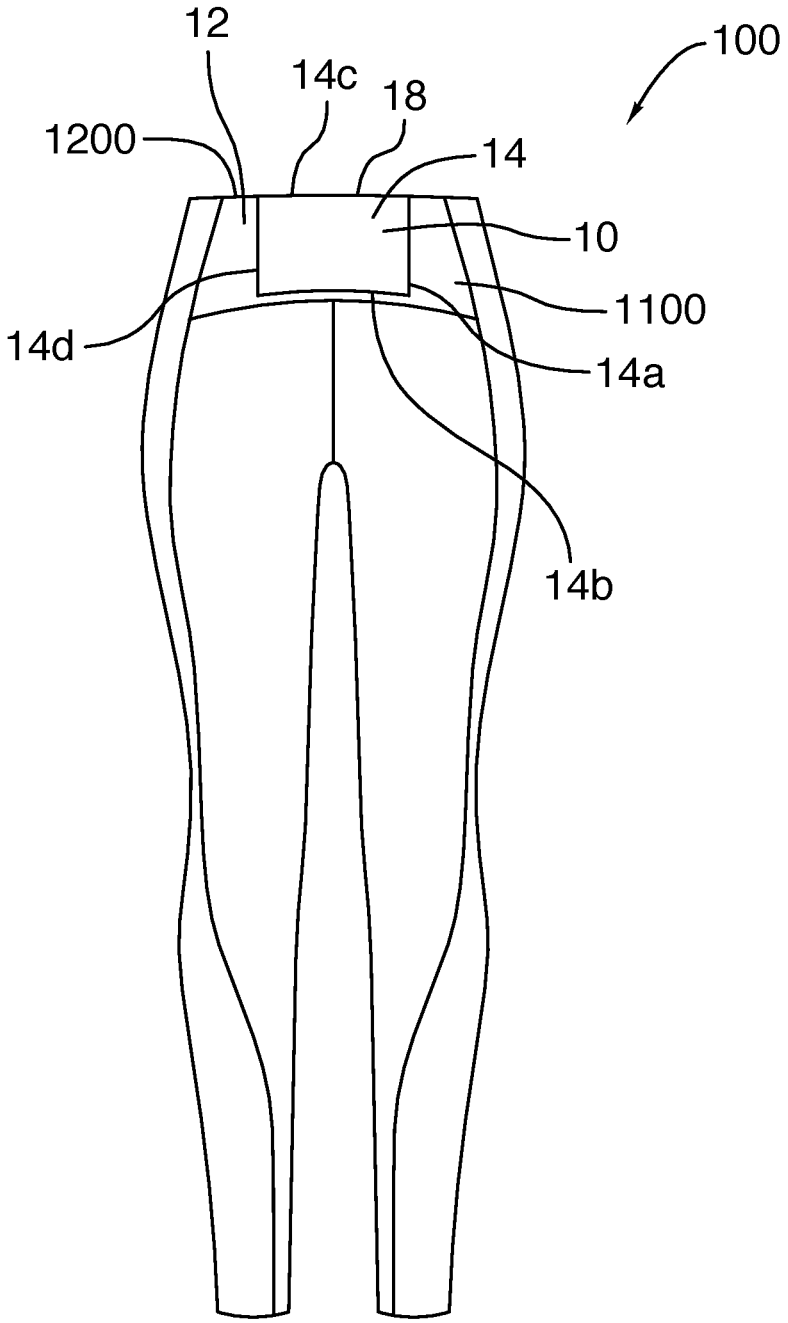
FIG. 1 is a rear view illustrating an example of a garment having a pocket formed in the waistband thereof.
Figure 2:
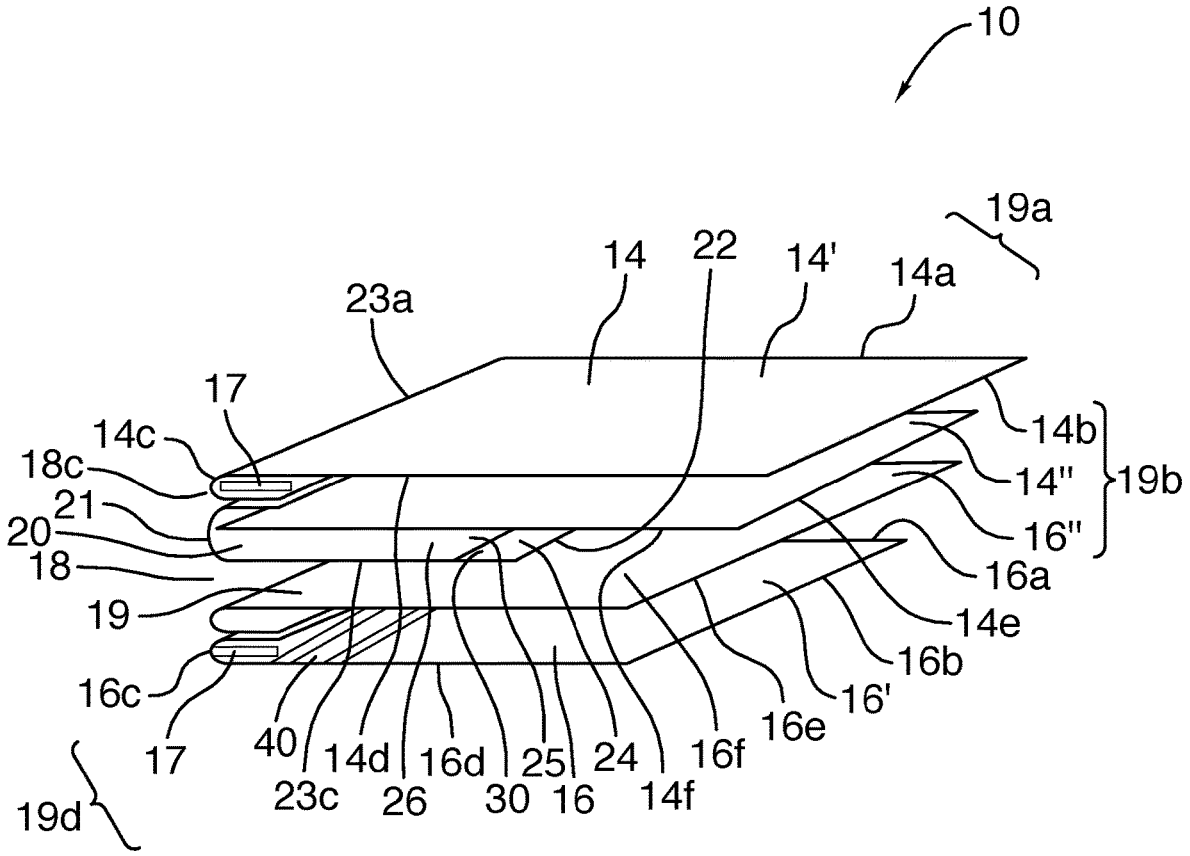
FIG. 2 is a cross-sectional exploded view of an example of a pocket for a garment.

In the following description, details are set forth to provide an understanding of the application. In some instances, certain structures, techniques, and methods have not been described or shown in detail in order not to obscure the application FIG. 1 illustrates a garment 100, such as for example pants, having a waist band 12 and a pocket 10 formed in the waistband 12. The pocket 10 can be sized to fit a smartphone or other personal items. The pocket 10 further comprises a gripper or gripping surface 30 that is configured to prevent or reduce bouncing action or shifting or moving of the personal items (e.g., smartphone, etc.) within the pocket 10. Details of the pocket 10 are illustrated in FIG. 2.

The pocket 10 comprises an outer panel 14 and an inner panel 16 that are attached along respective right and left (or first and second) side edges 14*a*, 14*d*, 16*a*, 16*d* and bottom edges 14*b*, 16*b*. Respective top edges 14*c*, 16*c* of the outer and inner panels 14, 16 are not attached thus forming a pocket opening 18 of a pocket bag 19 formed therein between the panels 14, 16. Persons skilled in the art would understand that the side edges 14*a*, 14*d*, 16*a*, 16*d* are edges that are sidewise or to the sides of the pocket opening 18 and the bottom edges 14*b*, 16*b* are opposite the pocket opening 18. The outer panel 14 can be a part of the outer panel 1100 of the garment 100, such as for example the outer panel 1100 of the waistband 12. In the example illustrated in FIG. 2, the outer panel 14 can comprise an outer layer 14' and an outer liner 14" which can be adhered or attached together at least partially along a portion of a perimeter edge 14*e* of the outer liner 14". The inner panel 16 can be a part of the inner panel 1200 of the garment 100, such as for example, the inner panel 1200 of the waistband 12. In the illustrated example, the inner panel 16 can also comprise an inner layer 16' and an inner liner 16" adhered or attached together at least partially along a perimeter edge 16*e* of the inner liner 16". In one embodiment, the outer layer 14' of the outer panel 14 can be an outer (fabric) panel 1100 of the garment 100 (e.g., a front portion of the waistband 12) while the inner layer 16' can be the inner (fabric) panel 1200 of the garment 100 (e.g., an inner portion of the waistband 12). Hence, the pocket bag 19 can be formed by attaching the outer liner 14" to the inner liner 16", or attaching one of the outer or inner liners 14", 16" to the respective inner or outer layers 16', 14', or by simply attaching the outer and the inner panels 14, 16 forming the closed side edges 19*a*, 19*d* and bottom edge 19*b* of the pocket bag 19. The pocket 10 can further be stabilized by positioning a pocket stabilizer 17 at one or more of the top edges 14*c*, 16*c* of the outer and inner panels 14, 16 along the edge 18*c* of the pocket opening 18. The pocket stabilizer(s) 17 can be added to the outer layer 14' and to the inner layer 16'. For example, the pocket stabilizer(s) 17 can be made from a flex rubber, an elastic tape, etc. The pocket stabilizer(s) 17 can be placed behind the outer and the inner layers 14', 16'. For example, the top edges 14*c*, 16*c* of the outer and inner layers 14', 16' can be folded over the stabilizer(s) 17.

The pocket 10 further comprises an internal pocket flap 20 that can be attached to either the outer pocket panel 14 or the inner pocket panel 16 along the edge 18*c* of the pocket opening 18. A top edge 21 and side edges 23*a*, 23*c* of the flap 20 are connected to respective edges 14*a*, 14*c*, 16*a*, 16*c* of either the outer pocket panel 14 or the inner pocket panel 16 forming an internal pocket 24. Depending on whether the flap 20 is attached to the outer panel 14 or the inner panel 16, the internal pocket 24 can face the outer panel 1100 of the garment 100 or the inner panel 1200 of the garment 100. A bottom edge 22 of the flap 20 is free hanging forming an entrance opening 25 to the internal pocket 24. The internal pocket 24 is sized and shaped so that personal items, such as for example a smartphone, can be secured therein. The length of the internal flap 20 (i.e., how far it extends into the pocket bag 19) is less than the depth of the pocket bag 19, meaning that the length of the side edges 23*a*, 23*c* of the internal pocket 24 is less than the length of the side edges 14*a*, 16*a* of the pocket bag 19. For example, the length of the internal flap 20 can be ⅔ of the depth of the pocket bag 19. The internal flap 20 can be made from any suitable elastic material. In one embodiment, the internal flap 20 can be made of a meshed material.

A gripping surface 30 is formed on an inner face 26 of the internal pocket 24. For example, the gripping surface 30 can be formed on an inner face 26 of the flap 20 or on an inner face 14*f*, 16*f* of the outer and inner panels 14, 16, so that when an item is inserted into the internal pocket 24, it is adheres or sticks to (i.e., removable adheres or sticks to) the griping surface 30 preventing or reducing bouncing action of the item within the internal pocket 24. In one embodiment, the gripping surface 30 can be a silicone elastic goop or material that can be formed on or positioned proximate the bottom edge 22 of the flap 20. For example, the silicone elastic goop 30 can be attached to the internal pocket flap 20 by coverstitching. In one embodiment, the gripping surface 30 can comprise at least one silicone strip formed on the inner face 26 of the internal pocket 24. In another embodiment, the gripping surface 30 can comprise a number of silicone dots or portions formed of the inner face 26 of the internal pocket 24 (e.g., on the inner face 26 of the flap 20 or on inner face 14*f*, 16*f* of the outer and/or inner panels 14, 16).

Optionally the garment 100 can include a drawstring or drawcord 40 for tightening the waistband 12 of the garment 100 against the waist of a wearer. The drawcord 40 may be positioned or encased in fabric on the inside of the garment 100 below the top edge 16*c* of the inner panel 16 as shown in FIGS. 2 and 3.

Figure 3:
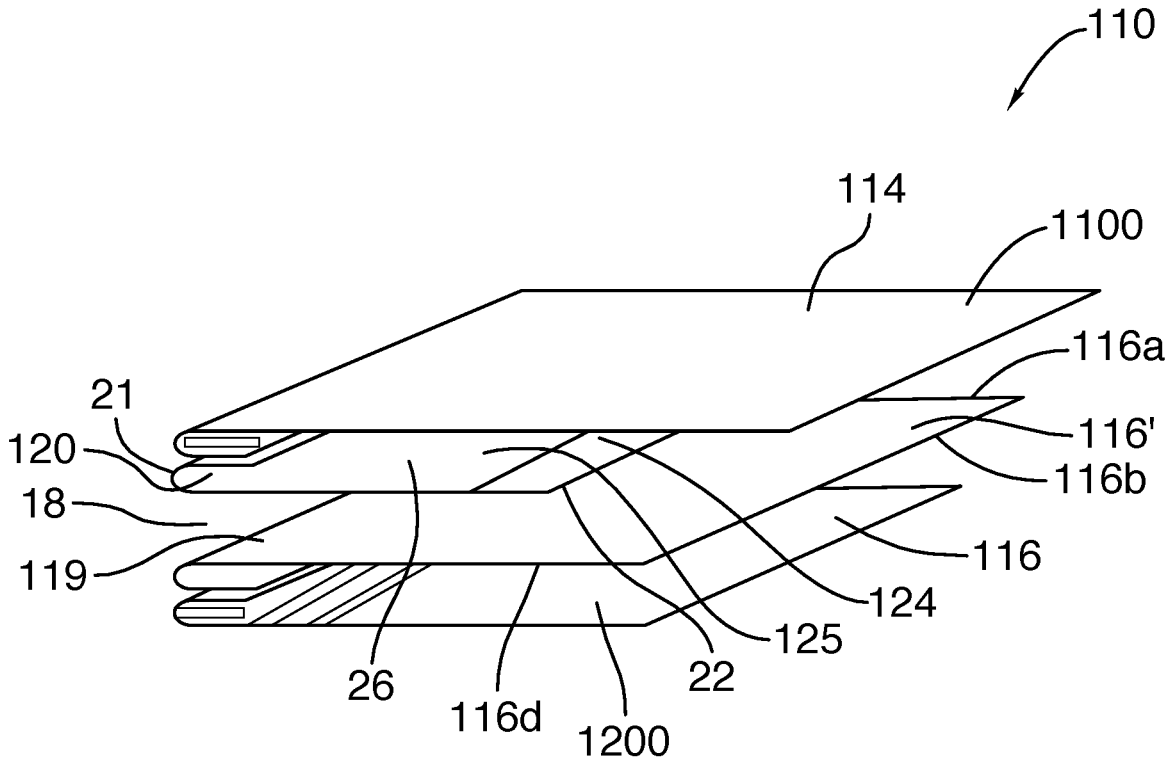
FIG. 3 is a cross-sectional exploded view of another example of a pocket for a garment.

FIG. 3 illustrates an example of a pocket 110 wherein the outer panel 114 of the pocket 110 is part of the outer fabric 114 of the garment 100. In this embodiment, an internal pocket flap 120 can be connected to the outer fabric 114 of the garment 100, such as for example, the outer portion 1100 of the waistband 12 to form an internal pocket 124. An inner liner 116' of the inner panel 116 can be attached to the outer fabric 114 along the side edges 116*a*, 116*d* and bottom edge 116*b* thereof forming a pocket bag 119. In another embodiment, the inner panel 116 of the pocket 10, 110 can be the inner fabric 116 of the garment 100 (e.g., the inner fabric 1200 of the waistband 12) and the pocket bag 19, 119 can be formed by attaching the outer liner layer 14" to the inner fabric 116. The internal pocket flap 20, 120 can be connected to the outer or inner fabrics 114, 116, so that the internal storage pocket 124 can face the outer fabric 114 or the inner fabric 116 of the garment 100 without departing from the scope of the disclosure.

Figure 4:
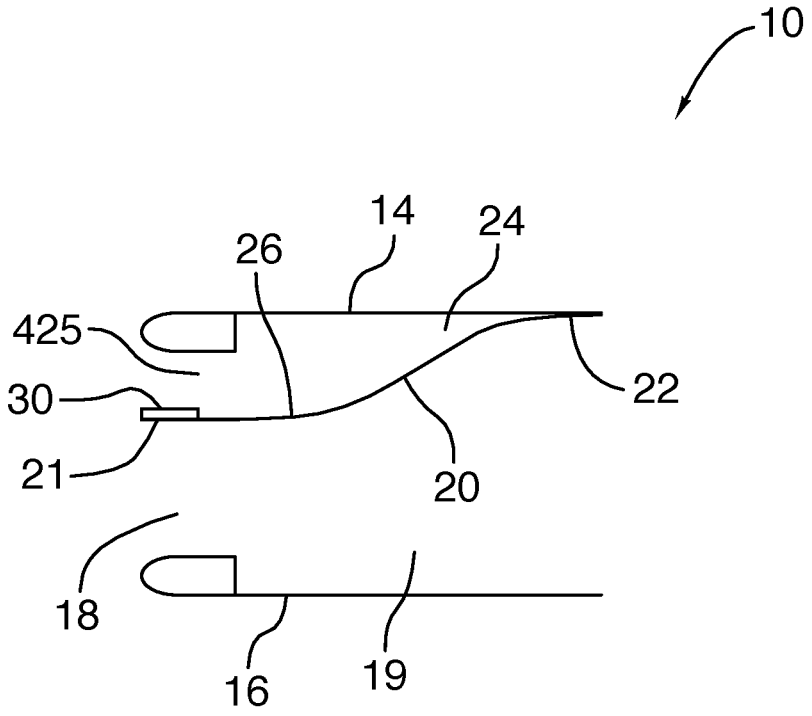
FIG. 4 is a cross-sectional exploded view of another example of a pocket for a garment.

In one embodiment as shown in FIG. 4, the entrance opening 425 of the internal pocket 24, 124 can be aligned with the pocket opening 18 of the pocket bag 19, 119. In this embodiment, the bottom edge 22 of the flap 20, 120 is not free-hanging but rather is attached to either the outer or inner panel 14, 16 of the pocket bag 19, 119 while the top edge 21 of the flap 20, 120 is not connected thus forming the entrance opening 425 of the internal pocket 24, 124. The gripping surface 30 can be formed on the inner face 26 of the internal pocket 24, 124 proximate the entrance opening 425.

Figure 5:
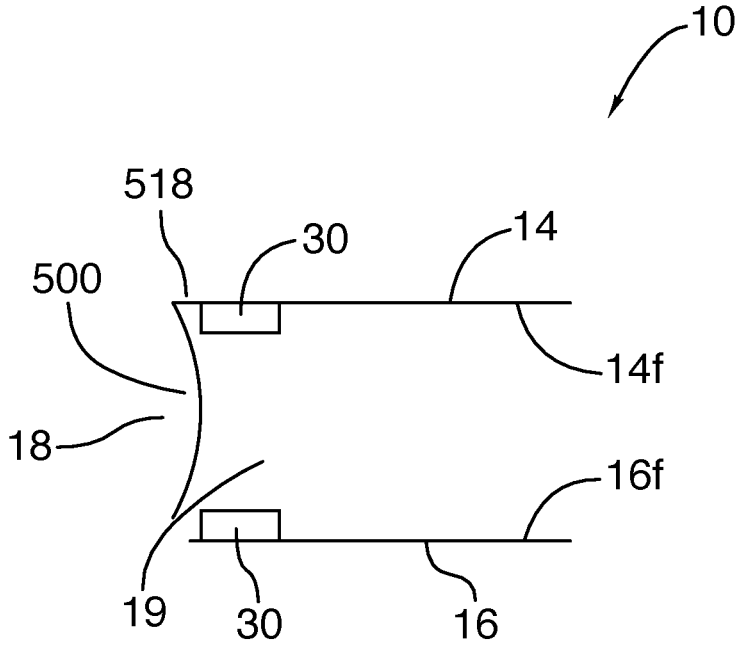
FIG. 5 is a cross-sectional exploded view of another example of a pocket for a garment.

In another embodiment as shown in FIG. 5, the internal pocket 24, 124 can be omitted and the gripping surface 30 can be formed on the inner face (e.g., 14*f*, 16*f*) of one or both of the panels 14, 16 of the pocket bag 19, 119. For example, the gripping surface 30 can be formed or attached proximate the edge 518 of the pocket opening 18 or at any other suitable location. In one embodiment, an elastic pocket flap 500 can be provided which is extendable over the pocket opening 18 in order to close the pocket opening 18 and secure items within the pocket bag 19, 119.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the disclosure.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A pocket for a garment, comprising:

a pocket bag having an upward facing pocket opening, the pocket bag being formed by attaching an outer panel to an inner panel along respective side edges and bottom edges thereof, the upward facing pocket opening formed proximate to or along a top edge of the pocket and facing toward a top edge of the garment;

a pocket flap attached to either the outer panel or the inner panel along a top edge thereof and at least a portion of the side edges thereof forming an internal storage pocket, side edges of the internal storage pocket being shorter than the side edges of the pocket bag, a bottom edge of the pocket flap being free-hanging forming a downward facing entrance opening to the internal storage pocket, the downward facing entrance opening positioned beneath the top edge of the pocket and the upward facing pocket opening; and a gripping surface formed on an inner face of the internal storage pocket, wherein the gripping surface is an elastic silicone strip attached proximate the entrance opening of the internal storage pocket;

wherein an item inserted into the inner storage pocket sticks to the griping surface preventing or reducing bouncing action of the item within the pocket;

wherein the outer panel is a single outer panel and wherein the single outer panel is attached directly to the inner panel along the respective side edges and bottom edges thereof; and, wherein the pocket is formed in a waistband on a back side of the garment, wherein the outer panel is a portion of an outer panel of the waistband, wherein the inner panel is a portion of an inner panel of the waistband, wherein the top edges of the outer panel and the inner panel form a top edge of the waistband, the top edge of the pocket, and the top edge of the garment, and wherein the top edges of the outer panel and the inner panel are unattached to thereby form the upward facing pocket opening.

2. The pocket according to claim 1, wherein the internal pocket flap is an elastic mesh.

3. The pocket according to claim 1, wherein a length of the pocket flap is two-thirds a depth of the pocket bag.

4. The pocket according to claim 1, wherein the garment is a skirt or a pair of shorts or pants.

5. The pocket according to claim 1, wherein the gripping surface is attached to the pocket flap.

6. The pocket according to claim 1, further comprising a pocket stabilizer positioned at the top edge of either the outer panel or the inner panel, wherein the pocket stabilizer is made from a flex rubber or an elastic tape, and wherein the top edge of either the outer panel or the inner panel is folded over the pocket stabilizer.

7. The pocket according to claim 1, wherein the top edge of the pocket is formed proximate to or along the top edge of the garment at a waist opening of the garment.

8. A pocket for a garment, comprising:

a pocket bag having an upward facing pocket opening, the upward facing pocket opening formed proximate to or along a top edge of the pocket and facing toward a top edge of the garment; and a gripping surface formed on an inner face of the pocket bag;

wherein the gripping surface is an elastic silicone strip attached proximate a downward facing entrance opening of an internal storage pocket formed within the pocket bag by a pocket flap, the downward facing entrance opening positioned beneath the top edge of the pocket and the upward facing pocket opening;

wherein an item inserted into the pocket sticks to the griping surface preventing or reducing bouncing action of the item within the pocket;

wherein the pocket flap is attached to either an outer pocket panel or an inner pocket panel of the pocket bag along an edge of the pocket opening and to at least a portion of side edges of the outer or inner pocket panels that are perpendicular to the edge of the pocket opening; and, wherein the outer pocket panel is a single outer pocket panel and wherein the single outer pocket panel is attached directly to the inner pocket panel along respective side edges and bottom edges thereof; and, wherein the pocket is formed in a waistband on a back side of the garment, wherein the outer pocket panel is a portion of an outer panel of the waistband, wherein the inner pocket panel is a portion of an inner panel of the waistband or garment, wherein top edges of the outer pocket panel and the inner pocket panel form a top edge of the waistband, the top edge of the pocket, and the top edge of the garment, and wherein the top edges of the outer pocket panel and the inner pocket panel are unattached to thereby form the upward facing pocket opening.

9. The pocket according to claim 8 wherein a bottom edge of the pocket flap is free-hanging and forms the entrance opening to the internal storage pocket.

10. The pocket according to claim 9, wherein the elastic silicone strip is attached to an inner face of the pocket that is also an inner face of the internal storage pocket.

11. The pocket according to claim 10, wherein the gripping surface is attached to the pocket flap.

12. The pocket according to claim 8, wherein a length of the pocket flap is two-thirds a depth of the pocket bag.

13. The pocket according to claim 8, wherein the garment is a skirt or a pair of shorts or pants.

14. The pocket according to claim 8, further comprising a pocket stabilizer positioned at a top edge of either the outer pocket panel or the inner pocket panel, wherein the pocket stabilizer is made from a flex rubber or an elastic tape, and wherein the top edge of either the outer pocket panel or the inner pocket panel is folded over the pocket stabilizer.

15. The pocket according to claim 8, wherein the top edge of the pocket is formed proximate to or along the top edge of the garment at a waist opening of the garment.

* * * * *